US008094852B2

(12) United States Patent
Ikuma et al.

(10) Patent No.: US 8,094,852 B2
(45) Date of Patent: Jan. 10, 2012

(54) HEADSET

(75) Inventors: Michihito Ikuma, Shizuoka (JP); Yasuhisa Kaneda, Shizuoka (JP)

(73) Assignee: Sony Corporation, Tokyo (JP)

( * ) Notice: Subject to any disclaimer, the term of this patent is extended or adjusted under 35 U.S.C. 154(b) by 1181 days.

(21) Appl. No.: 11/893,883

(22) Filed: Aug. 16, 2007

(65) Prior Publication Data

US 2008/0044051 A1 Feb. 21, 2008

(30) Foreign Application Priority Data

Aug. 18, 2006 (JP) ..... P2006-223047

(51) Int. Cl.
*H04R 25/00* (2006.01)

(52) U.S. Cl. ..... 381/330; 381/381; 381/374

(58) Field of Classification Search ..... 381/330, 381/366, 381, 374
See application file for complete search history.

(56) References Cited

U.S. PATENT DOCUMENTS

| | | | | |
|---|---|---|---|---|
| 5,117,465 | A * | 5/1992 | MacDonald | 381/379 |
| 5,134,655 | A * | 7/1992 | Jensen | 379/430 |
| 5,369,857 | A * | 12/1994 | Sacherman et al. | 29/594 |
| 5,457,751 | A * | 10/1995 | Such | 381/375 |
| 5,469,505 | A * | 11/1995 | Gattey et al. | 379/430 |
| 6,041,130 | A * | 3/2000 | Goss | 381/374 |
| 6,252,970 | B1 * | 6/2001 | Poon et al. | 381/374 |
| 6,496,589 | B1 * | 12/2002 | Pham et al. | 381/375 |
| 6,622,029 | B1 * | 9/2003 | Skulley et al. | 455/575.2 |
| 6,748,095 | B1 * | 6/2004 | Goss | 381/374 |
| 6,754,361 | B1 * | 6/2004 | Hall et al. | 381/370 |
| 6,970,572 | B2 * | 11/2005 | Murozaki et al. | 381/381 |
| 7,245,737 | B2 * | 7/2007 | Amae et al. | 381/374 |
| 7,391,863 | B2 * | 6/2008 | Viduya et al. | 379/430 |
| 7,436,952 | B2 * | 10/2008 | Darbut | 379/430 |
| 7,508,932 | B1 * | 3/2009 | Bergh | 379/430 |
| 7,519,196 | B2 * | 4/2009 | Bech | 381/371 |
| 7,564,988 | B2 * | 7/2009 | Azima et al. | 381/326 |
| 7,590,255 | B2 * | 9/2009 | Nielsen | 381/328 |
| 7,831,058 | B2 * | 11/2010 | Chen | 381/361 |
| 2002/0031238 | A1 * | 3/2002 | Murozaki et al. | 381/381 |
| 2002/0196960 | A1 * | 12/2002 | Pham et al. | 381/375 |
| 2005/0123157 | A1 * | 6/2005 | Kragelund et al. | 381/312 |
| 2005/0226452 | A1 * | 10/2005 | Amae et al. | 381/381 |
| 2007/0025574 | A1 * | 2/2007 | Azima et al. | 381/330 |
| 2007/0064967 | A1 * | 3/2007 | Feeley et al. | 381/330 |
| 2007/0183615 | A1 * | 8/2007 | Wurfel | 381/330 |
| 2007/0195981 | A1 * | 8/2007 | Le | 381/330 |
| 2007/0258613 | A1 * | 11/2007 | Wright | 381/374 |
| 2008/0013776 | A1 * | 1/2008 | Chen | 381/381 |
| 2008/0044051 | A1 * | 2/2008 | Ikuma et al. | 381/375 |
| 2008/0298622 | A1 * | 12/2008 | Lee | 381/378 |
| 2009/0087006 | A1 * | 4/2009 | Leong | 381/324 |

(Continued)

FOREIGN PATENT DOCUMENTS

| | | |
|---|---|---|
| CN | 1126936 | 7/1996 |

(Continued)

*Primary Examiner* — David S. Warren
(74) *Attorney, Agent, or Firm* — Frommer Lawrence & Haug LLP; William S. Frommer; Ellen Marcie Emas

(57) ABSTRACT

A headset for using an electronic device worn on a head, includes an ear clip formed to have a shape conforming to and wearable on a root of auricle. The ear clip includes a core that can plastically be deformed according to a difference between shapes of the root of auricle and a protecting material that covers the core.

7 Claims, 5 Drawing Sheets

U.S. PATENT DOCUMENTS

| | | | | |
|---|---|---|---|---|
| 2009/0103765 | A1* | 4/2009 | Bruckhoff et al. | 381/381 |
| 2009/0175481 | A1* | 7/2009 | Amae | 381/375 |
| 2009/0203318 | A1* | 8/2009 | Haan | 455/41.3 |
| 2009/0285434 | A1* | 11/2009 | Williams et al. | 381/375 |
| 2010/0014699 | A1* | 1/2010 | Anderson et al. | 381/375 |
| 2010/0086165 | A1* | 4/2010 | Wilson | 381/374 |
| 2010/0124349 | A1* | 5/2010 | Bass | 381/379 |
| 2011/0007926 | A1* | 1/2011 | Murozaki | 381/374 |

FOREIGN PATENT DOCUMENTS

| | | |
|---|---|---|
| EP | 690654 A2 * | 1/1996 |
| JP | 59 139786 | 8/1984 |
| JP | 61 26389 | 2/1986 |
| JP | 8 33079 | 2/1996 |
| JP | 9 307983 | 11/1997 |
| JP | 3068203 | 2/2000 |
| JP | 2000 165976 | 6/2000 |
| JP | 2003 18683 | 1/2003 |
| JP | 2003 78984 | 3/2003 |
| JP | 2003 188967 | 7/2003 |
| JP | 2004 64537 | 2/2004 |
| JP | 2005 191767 | 7/2005 |
| WO | WO 2005 025267 | 3/2005 |
| WO | WO 2005 071929 | 8/2005 |

* cited by examiner

HEADSET

CROSS REFERRENCES TO RELATED APPLICATIONS

The present invention contains subject matter related to Japanese Patent Application JP 2006-223047 filed in the Japan Patent Office on Aug. 18, 2006, the entire contents of which being incorporated herein by reference.

BACKGROUND OF THE INVENTION

1. Field of the Invention

The present invention relates to a headset worn on a user's head.

2. Description of the Related Art

Along with diffusion of various computer devices and mobile devices, also headsets worn on the head of a human body for use have recently been put to practical use in various ways. Known specific examples among them include the so-called headphone type headset in which a microphone is attached to a headphone (see e.g. Japanese Patent Laid-open No. 2003-188967), and the so-called earphone type in which a microphone is provided in a cord branch cover of a stereo type earphone (see e.g. Japanese Patent Laid-open No. 2004-64537).

SUMMARY OF THE INVENTION

Incidentally, since the headset is worn on the head of a human body for use, it may require downsizing and weight reduction. Some headsets need only a sound collecting function (microphone) for audio-visual (AV) presentation but do not need a sound-receiving function, for instance. Such headsets have desired inconspicuousness when worn and response to bodily movement (to enable sound collection while maintaining a reliably worn state) as well as downsizing and weight reduction.

However, the headphone type headsets in the past are not easily reduced in size and in weight and also it is difficult for them to be made inconspicuous when worn. On the other hand, earphone type headsets in the past are easily reduced in size and in weight as compared with the headphone type headsets. However, they need an earphone even when a sound-receiving function is unnecessary; therefore, the earphone type headset is not preferable in constructing a headset that needs only a sound-collecting function. In addition, since it is difficult to fix a microphone at a constant position, response to the bodily movement is not necessarily appropriate.

It is desirable to provide a headset that can deal with downsizing and with weight reduction, can be worn inconspicuously and can provide an excellent wearing feeling even when a wearer's body moves.

A headset according to an embodiment of the present invention is for using an electronic device worn on a head, and includes an ear clip formed to have a shape conforming to and wearable on a root of auricle. The ear clip includes a core that can plastically be deformed according to a difference between shapes of the root of auricle and a protecting material that covers the core.

In the headset configured as described above, the ear clip is formed to have a shape conforming to and wearable on the root of auricle. "The shape conforming to the root of auricle" refers to a shape according to the shape of the auricled root of a human body and to an average shape taking into account an individual difference and the like. "The shape wearable on the root of auricle" refers to a shape taking into account wearing on the auricled root of a human body, and specifically to a shape in which both ends of the ear clip are spaced apart from each other, that is, are not closed. With such a shape, the ear clip is worn or hooked on the auricled root of the human body. Thus, the headset provided with the ear clip is worn on the head of the human body by hooking the ear clip on the auricled root of the human body.

In addition, the ear clip includes the core that can plastically be deformed and the protecting material that covers the core. Therefore, after the ear clip is worn on the root of auricle, the core is plastically deformed so as to conform to the shape of the root of auricle, thereby maintaining the state after the deformation. Since the core is covered by the protecting material, it does not come into contact with the human body even if the core is made of a plastically deformable metal wire rod.

According to the headset of the embodiment of the present invention, when the headset is to be worn on the head of a human body, the ear clip is to be hooked on the root of auricle. In addition, the ear clip corresponds to an ear of a human body. The headset does not need a head band for the headphone type or an earphone for the earphone type. Thus, the headset can be worn with a very simple configuration as compared with that in the past, which consequently makes it very easy to deal with downsizing and weight reduction. Since it is necessary to hook the ear clip on the root of auricle, any one can wear the headset easily and the ear clip is hidden by the auricle after the headset is worn, which makes the ear clip inconspicuous.

Further, use of the plastic deformation of the core makes it possible to allow the shape of the ear clip to conform to the shape of the wearer's root of auricle. Therefore, the wearer can obtain an excellent wearing feeling and high versatility capable of flexibly dealing with individual difference among wearers can be ensured. This exhibits an excellent effect particularly when a wearer's body moves. In other words, the plastic deformation of the core is used to enhance the wearing feeling of the headset. Even when the wearer's body moves, the acoustic device can be fixed at a given position with respect to the position of the ear or mouth of the wearer's body; therefore, the headset can appropriately deal with such movement.

DETAILED DESCRIPTION OF THE PREFERRED EMBODIMENT

A headset according to an embodiment of the present invention will hereinafter be described with reference to the drawings.

Figure 1:
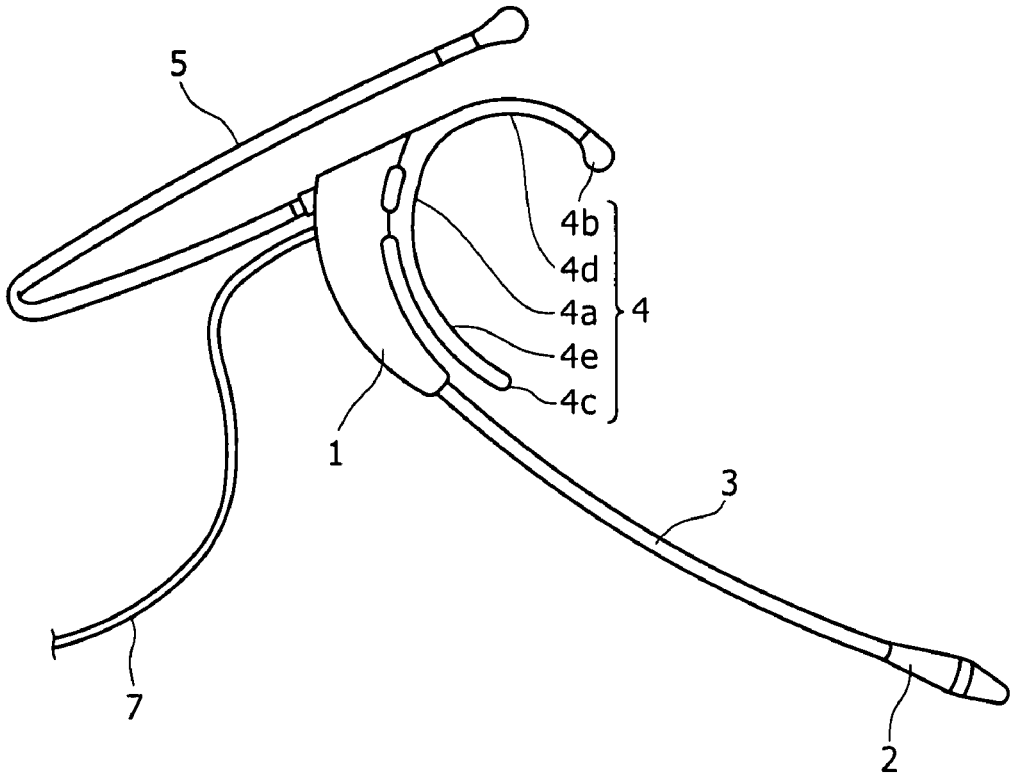
FIG. 1 is an explanatory view illustrating external appearance of a headset according to an embodiment of the present invention.
Figure 2:
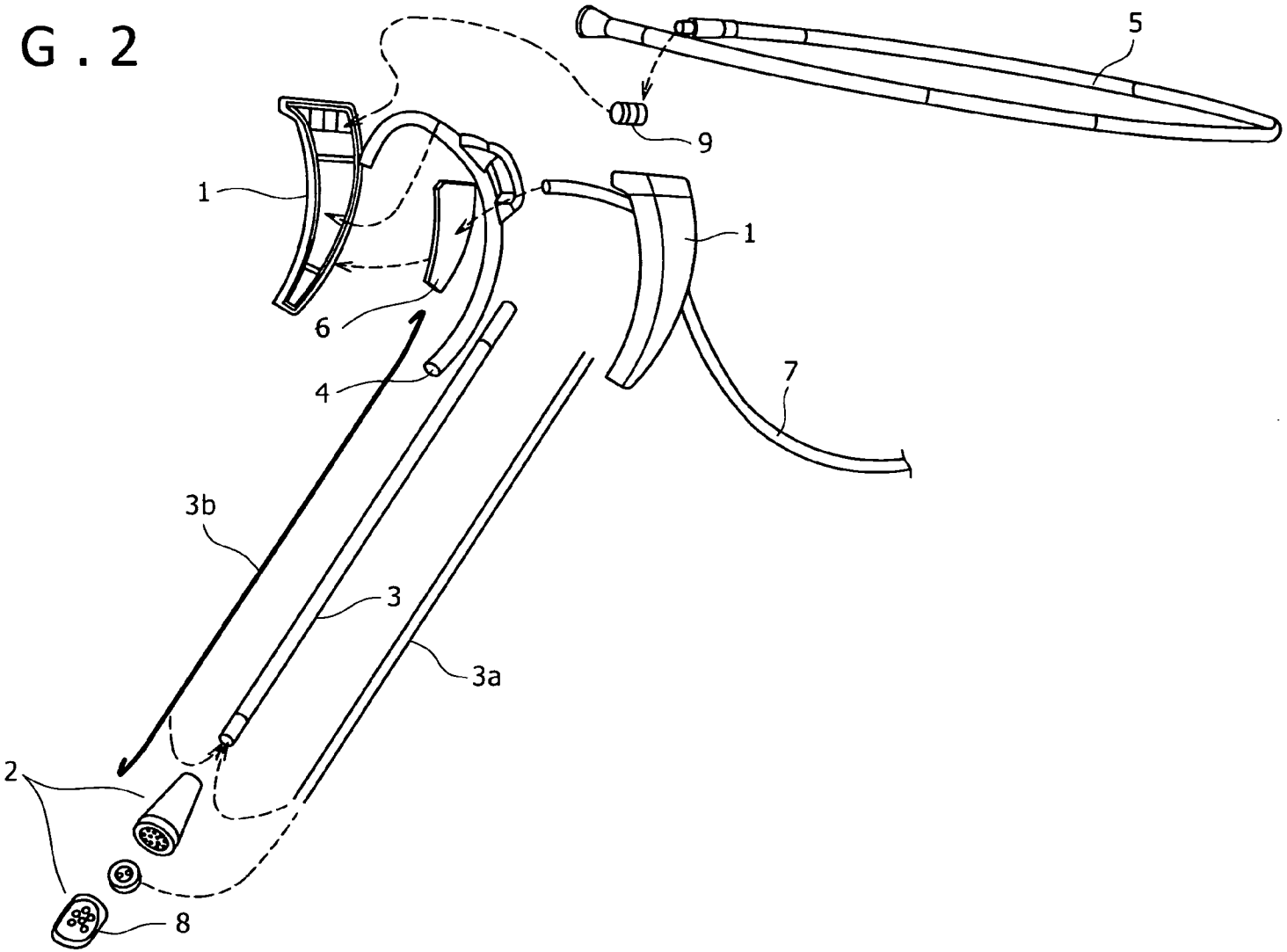
FIG. 2 is an exploded perspective view of the headset of the embodiment.
Figure 3:
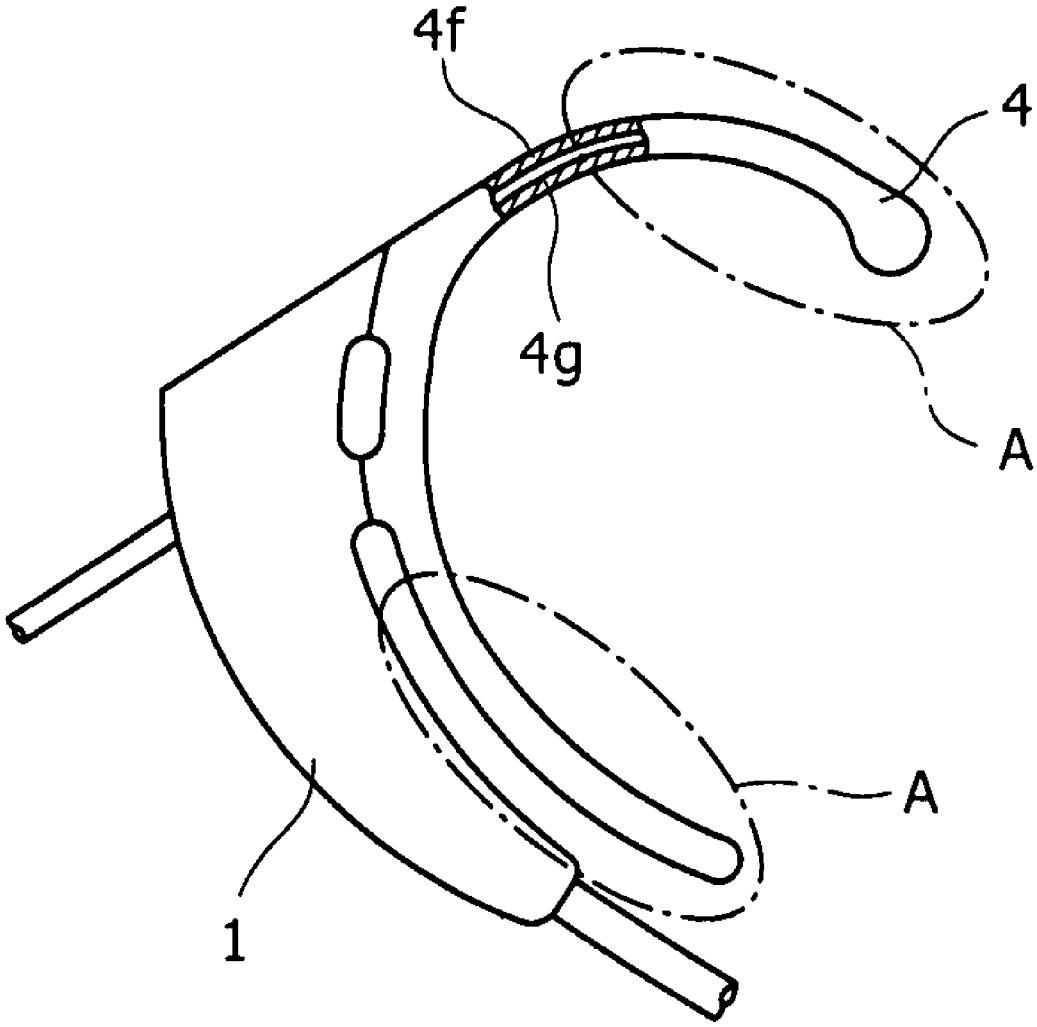
FIG. 3 is an explanatory view illustrating a major portion of the headset of the embodiment.
Figure 4A:
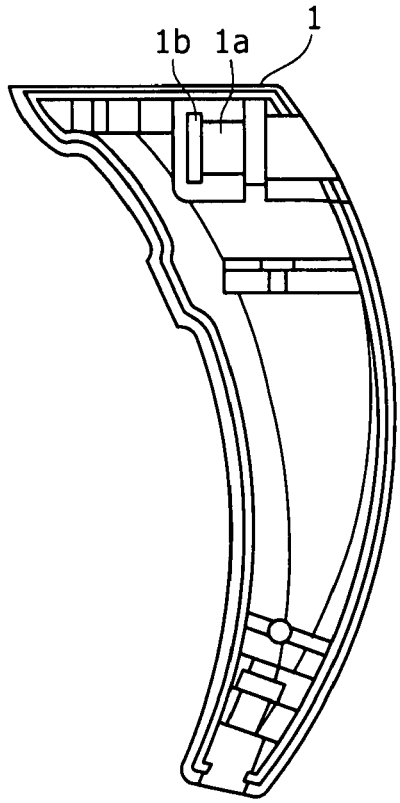
FIGS. 4A, 4B and 4C are explanatory views illustrating the major portion of the headset according to the embodiment of the present invention.
Figure 4B:
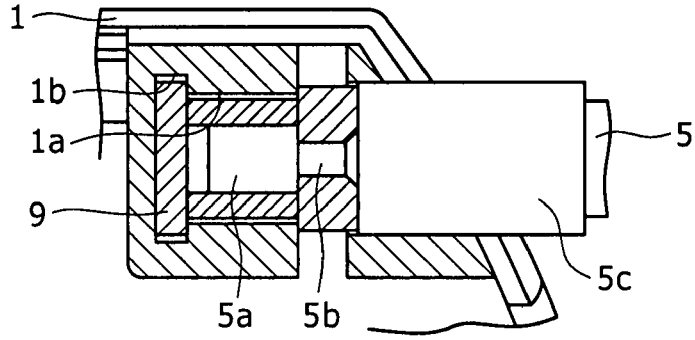
Figure 4C:
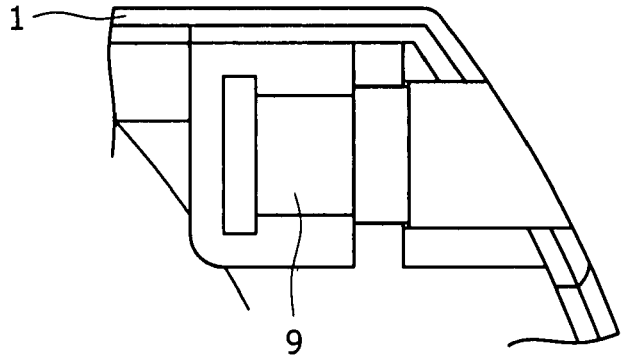
Figure 5:
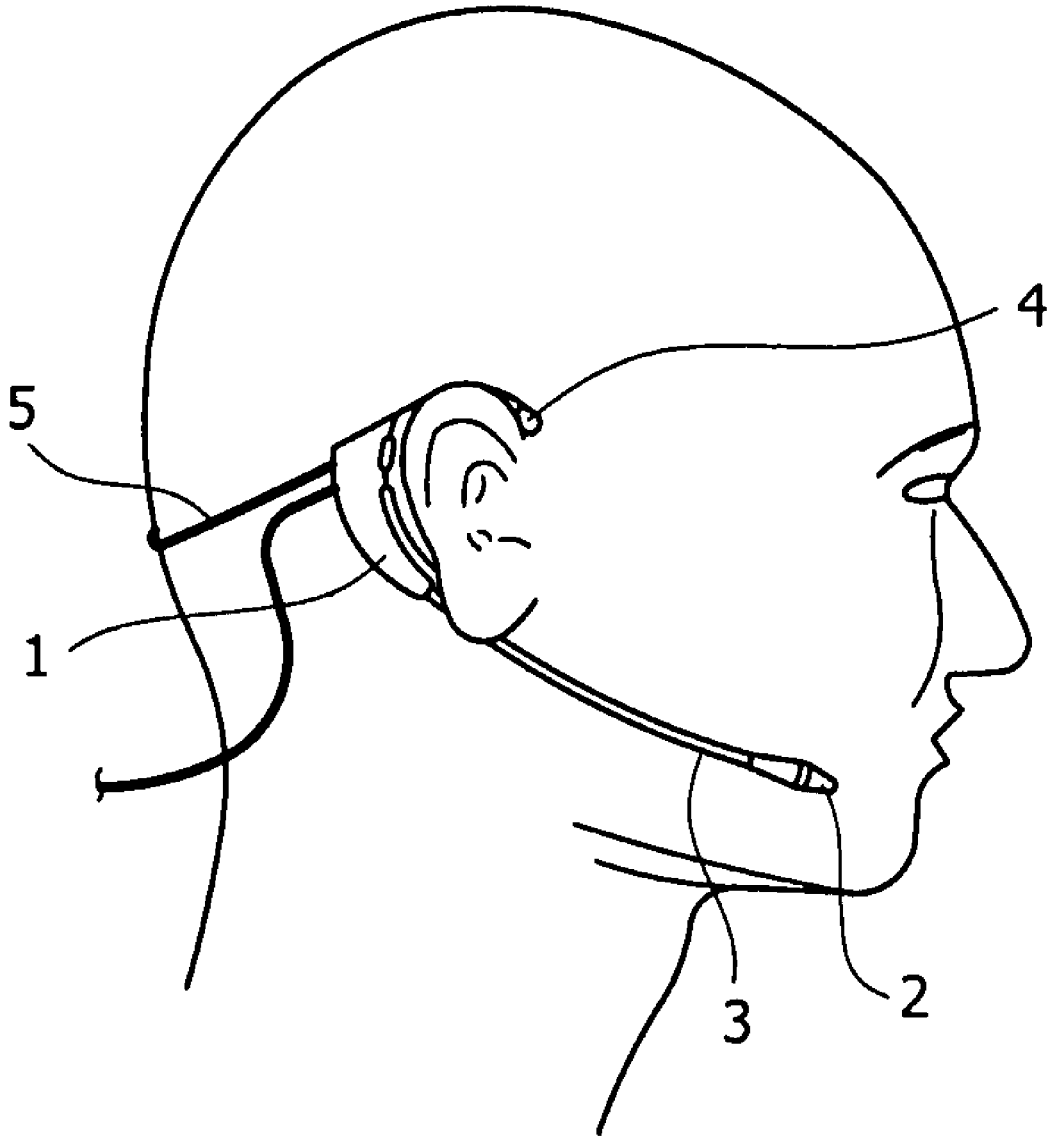
FIG. 5 is an explanatory view illustrating the headset of the embodiment worn on the human body by way of example.

FIG. 1 is an explanatory view illustrating external appearance of a headset according to an embodiment of the present invention. FIG. 2 is an exploded perspective view of the headset of the embodiment. FIG. 3 is an explanatory view illustrating a major portion of the headset of the embodiment. FIGS. 4A, 4B and 4C are explanatory views illustrating the major portion of a headset according to the embodiment. FIG. 5 is an explanatory view illustrating the headset of the embodiment worn on the human body by way of example.

A headset according to an embodiment of the present invention is such that a microphone which is one of audio devices is worn on the head of a human body for use. Referring to FIGS. 1 and 2, the headset includes a case main body 1, a microphone capsule 2, a microphone arm 3, an ear clip 4 and a head band 5.

The case main body 1 is molded with a resin material and incorporates therein a printed wiring board (PWB) 6 mounted with electronic components. A cable 7 extends outside of the case main body 1 from the printed wiring board 6 and is connected to external equipment (not shown) such as an amplifier or the like. Incidentally, the connection to the external equipment may be not wired via the cable 7 but may be wireless. In this case, a transmitter for wireless communication is attached to the case main body 1.

The microphone capsule 2 is molded with a resin material and incorporates therein a microphone 8 for collecting sound. The microphone 8 may be one that has directivity or an omnidirectional characteristic (nondirectional characteristic), which may be appropriately selected for use according to usage, purpose or the like.

The microphone arm 3 is a pipe-like elastic member, which extends from the case main body 1 and is provided with the microphone capsule 2 at its distal end. In addition, the microphone arm 3 incorporates therein a cord 3*a* and a metal wire rod 3*b*. The cord 3*a* is used to electrically connect the printed wiring board 6 with the microphone 8. The wire rod 3*b* is adapted to deform the microphone arm 3 into a shape the headset wearer desires and to maintain the shape resulting from the deformation.

The ear clip 4 is provided to wear the headset on the head of a human body. For that purpose the ear clip 4 is configured such that a linear member formed to have a shape conforming to the root of auricle of a human body and to have a shape wearable on the root of auricle is attached to the case main body 1. Incidentally, an attachment portion 4*a* attached to the case main body 1 is present at one position in the figures; however, the number of the attachment portions is not restrictive but may be one or three or more.

"The auricle" of a human body refers to a sectoral structure that is located at a temporal region of the human body and is composed of skin and a cartilage attached externally from an external auditory canal. "The root of auricle" refers to a boundary portion between an auricle and the head of a human body.

"The shape conforming to the root of auricle" refers to a shape according to the shape of the auricled root of a human body. The shape of an auricled root of a human body varies between individuals. An average shape taking into account an individual difference on the basis of an empirical rule resulting from the actual measurement of the shapes of persons is conceivably determined as "the shape conforming to the root of auricle".

"The shape wearable on the root of auricle" refers to a shape taking into account wearing on the auricled root of a human boy. Specifically, it refers to a shape in which both end portions 4*b*, 4*c* of the linear member constituting the ear clip 4 are spaced apart from each other, that is, to a shape that is not closed. The linear member constituting the ear clip 4 is divided into a first curve section 4*d* and a second curve section 4*e*. The first curve section 4*d* extends from the attachment portion 4*a* attached to the case main body 1 to one end 4*b* of the linear member and the second curve section 4*e* extends from the attachment portion 4*a* to the other end 4*c* of the linear member. Thus, the linear member is such that the end 4*b* of the first curve section 4*d* is spaced apart from the end 4*c* of the second curve section 4*c*. The distance between both the ends 4*b* and 4*c* is conceivably determined based on the empirical rule resulting from the actual measurement as with the case of "the shape conforming to the root of auricle" mentioned above.

Referring to FIG. 3, the ear clip 4 includes a core 4*f* and a protection material 4*g*. Specifically, the linear member constituting the ear clip 4 is formed to include at least the core 4*f* and the protection material 4*g*.

The core 4*f* is plastically deformable depending on the difference in the shape of the root of auricle. "The plastically deformable" means that the core can be deformed by applying thereto a force not lower than a yield point and not greater than allowable stress by a hand of a headset wearer and the shape resulting from the deformation can be maintained even after release of the force. Such a core material 4*f* may conceivably use a metal wire rod made of a stainless steel material, a steel material or the like.

The protecting material 4*g* is molded to cover the core 4*f*. However, since the core 4*f* is plastically deformable, the protecting material 4*g* is elastic so as to follow the deformation of the core 4*f*. Such a protecting material 4*g* conceivably uses the same resin material as the case main body 1. It is not necessarily to use the same material as the case main body 1 but other materials may be used. Alternatively, an elastic material such as rubber, sponge or the like may be used.

Because of including the core 4*f* and protecting material 4*g*, the ear clip 4, particularly, the first and second curve sections 4*d* and 4*e*, each exhibit the so-called called flexibility such as shape-plasticity or deformability (see symbol A in FIG. 3). It is preferred that the end 4*c* of the first curve section 4*d* located upside when the headset is worn be provided with a droplet-like bulge at its tip.

Referring again to FIGS. 1 and 2, the head band 5 is formed in a shape wearable on the occipital region of a human body and configured to be detachable from the case main body 1. "The shape wearable on the occipital region of a human body" means a shape taking into account wearing on the occipital region of a human body. Specifically, a horseshoe-shape formed slightly narrower than the occipital region is conceivable so as to hold the occipital region of the human body.

The configuration for achieving attachment and detachment of the head band 5 to and from the case main body 1 may be realized by using a fastener such as a screw or the like. To make it possible to attach and detach the head band 5 to and from the case main body 1, a configuration illustrated in FIGS. 4A, 4B and 4C may conceivably be applicable.

In this configuration, the head band 5 is formed at its one end portion with at least a columnar disengagement-prevention portion 5*a*, a columnar retaining portion 5*b* and a columnar main body-side portion 5*c* which are located in this order from the furthest end thereof. The retaining portion 5*b* has a smaller diameter than that of the disengagement-prevention portion 5*a*. The main body-side portion 5*c* has a larger diameter than that of the retaining portion 5*b*. The case main body 1 is formed with at least a round hole 1*a* and a retaining hole 1*b*. The round hole 1*a* extends longer than the total axial length of the disengagement-prevention portion 5*a* and retaining portion 5*b*. The retaining hole 1*b* is formed at the bottom of the round hole 1*a* and has a diameter larger than that of the round hole 1*a*. A bottomed cylindrical joint 9 is inserted into the round hole 1*a* and retaining hole 1*b* of the case main body 1. The bottomed cylindrical joint 9 is made of an elastic member such as rubber having a high elastic coefficient (a high degree of elastic deformation) and formed on its outer circumference with respective portions corresponding to the round hole 1*a* and the retaining hole 1*b* and on its inner circumference with respective portions corresponding to the disengagement-prevention portion 5*a* and retaining portion 5*b*.

With such a configuration, if the head band 5 is inserted into the inner circumferential side of the joint 9 from the end side thereof, the end portion of the head band 5 is engaged with the case main body 1 through the joint 9 while using the elastic deformation of the joint 9. Thus, the head band 5 is attached to the case main body 1. If the end portion of the head band 5 is pulled out of the inner circumferential portion of the joint 9, the end portion of the head band 5 is disengaged from the case main body 1 while using the elastic deformation of the joint 9. However, the head band 5 is disengaged at this time, so that the joint 9 is left inside the round hole 1*a* and retaining hole 1*b*, that is, left on the side of the case main body 1 because of engagement with the retaining hole 1*b*.

In other words, the head band 5 is configured so as to be able to be attached and detached to and from the case main body 1 without use of a tool or the like by the function using the shape of the end portion of the head band 5, the hole shape of the case main body 1 and the shape and elasticity of the joint 9. The head band 5 is attached and detached to and from the case main body 1 with such a configuration. Since the end portion of the head band 5 is formed circular and the holes of the case main body 1 are formed round, the head band 5 can turnably be attached to the case main body 1.

The headset configured described above is worn on a human body for use as illustrated in FIG. 5. More specifically, when wearing the headset 5, a wearer inserts his or her auricle into the portion between the end 4*b* of the first curve section 4*d* and the end 4*c* of the second curve section 4*e* in the ear clip 4 while hooking the air clip on the root of auricle. Thus, the ear clip 4 is worn on the wearer's auricled root. At this time, if the shape of the ear clip 4 does not conform to the shape of the wearer's auricled root, the wearer manually deforms the first and second curve sections 4*d* and 4*e* of the ear clip 4 to adjust wearing feeling so that the shape of the ear clip 4 is made to conform to the shape of the wearer's auricled root. If the head band 5 is attached to the case main body 1, the head band 5 holds the wearer's occipital region along with wearing of the ear clip 4 on the root of auricle. In this way, the headset is worn on the head of the wearer for use.

As described above, the headset of the present embodiment includes the ear clip 4 formed to conform to the root of auricle and to be wearable on the root of auricle. Therefore, a wearer can wear the headset on his or her head by hooking the ear clip 4 on his or her auricled root. In short, when the headset is worn on the head of a human body, it is necessary to hook the air clip 4 on the auricled root and also one ear clip 4 is necessary so as to correspond to one ear. Thus, the headset of the present embodiment does not have to have a head band extending over both ears unlike the headphone type headset in the past. It is not necessary to insert an earphone into an external auditory canal unlike the earphone type headset in the past. In addition, it is not necessary to grip an auricle with a headphone or an earphone and its accessories. The headset of the present embodiment can be worn on the head of a human body with a significantly simple configuration compared with that in the related art, which consequently makes it easier to deal with downsizing and weight reduction. Since the ear clip 4 is necessary to be hooked on the root of auricle, anyone can easily wear it. Since the ear clip 4 is hidden by the auricle after the headset has been worn, it also becomes inconspicuous. Since the case main body 1 is directly attached to the ear clip 4 via the attachment portion 4*a*, it is located rearward of the auricle when the headset is worn on the head of a human body. In other words, the constituent components of the headset are not present outside the auricle. This makes it possible to inconspicuously wear the headset itself as well as the ear clip 4.

The headset of the present embodiment is configured such that the ear clip 4 includes the plastically deformable core 4*f* and the protecting material 4*g* covering the core 4*f*. If, after the ear clip 4 is worn on the root of auricle, the core 4*f* is plastically deformed to conform to the shape of the auricled root, the state of the ear clip after the deformation can be maintained. In short, use of the plastic deformation of the core 4*f* can allow the shape of the ear clip 4 to conform to the shape of the auricled root of the wearer. Thus, the headset of the present embodiment can enable the wearer to have an excellent wearing feeling and also ensure high versatility to flexibly deal with the individual-differences among wearers. This exhibits an excellent effect particularly when a wearer's body moves. Specifically, use of the plastic deformation of the core 4*f* can enhance the wearing feeling of the headset; therefore, even when the wearer's body moves, the microphone 8 can be fixed at a given position relative to the positions of the ear or mouth of the wearer's body. Thus, the headset of the present embodiment can appropriately deal with such movement.

Further, since the core 4*f* is covered by the protecting material, it will not come into contact with the human body even if the core 4*f* is made of a plastically deformable metal wire rod. This can realize the excellent wearing feeling for the wearer and is preferable in view of safety, corrosion resistance and the like.

Because of this, it can be said that the headset of the embodiment can deal with downsizing and weight reduction and also can be worn easily and inconspicuously and additionally excellent wearing feeling can be obtained even when the wearer's body moves.

The head set of the present embodiment is provided with the detachable head band 5 in addition to the ear clip 4. When attached, the head band 5 holds the occipital region of the wearer's body. Thus, use of the head band 5 can further enhance the wearing feeling for the wearer and appropriately deal with intense movement. Since the head band 5 holds the occipital region of the wearer's body, the head band worn can be made inconspicuous as much as possible. Incidentally, the head band is preferably used particularly when the wearer's body intensely moves; however, it is not necessarily an basic constituent and the headset can be worn on the head of the human body by the ear clip 4.

The headset of the present invention is configured so that the head band 5 can be attached and detached to and from the case main body 1 by using the shape of the end portion of the head band 5, the shapes formed in the case main body 1 and the shape and elasticity of the joint 9. Therefore, the attachment and detachment of the head band can easily be realized without the necessity of a tool or the like, which can enhance convenience for the user (wearer) and can reduce the number of parts, thereby contributing to downsizing and weight reduction. Further, such a configuration enables the attachment and detachment; therefore, the head band 5 can turnably be attached to the case main body 1. Thus, turning the head band 5 can deal with the ear clip 4 worn on any of left and right ears. Also in this regard, convenience is enhanced for the user (wearer).

While the embodiment according to the present invention has been described thus far with reference to the specific examples, it does not limit the invention and can be modified or altered in the range not departing from the gist of the invention. For example, the embodiment is described taking as an example the case where the acoustic equipment of the headset is the microphone 8 for collecting sound. However, the present invention can similarly be applied to a case where a device for receiving sound is provided in addition to the microphone or to a case where the device for receiving sound is provided. In other words, even a headset that is not provided with a microphone but functions as a headphone or an earphone can be worn on the head of a human body using the ear clip according to the embodiment of the present invention. As described above with the embodiment, if the present invention is applied to the headset provided with the microphone, since the microphone itself is lightweight and the ear clip may not require a large attachment force, the invention can very easily realize downsizing and weight reduction and also enhance wearing feeling for a wearer.

It should be understood by those skilled in the art that various modifications, combinations, sub-combinations and alterations may occur depending on design requirements and other factors insofar as they are within the scope of the appended claims or the equivalents thereof.

What is claimed is:

1. A headset for using an electronic device worn on a head, comprising:

a case body incorporating therein the electronic device;

an ear clip including a first end, a first curved section extending from the first end, an attachment portion attached to the case body and extending from the first curved section, a second curved section extending from the attachment portion and a second end attached to an end of the second curved section, wherein the first and second ends, the first and second curved sections and the attachment portion formed to have a shape conforming to and wearable on a root of auricle and wherein the case body located behind the auricle when worn on the head;

wherein the ear clip includes a core that can plastically be deformed according to a difference between shapes of the root of auricle and a protecting material that covers the core.

2. The headset according to claim 1, further comprising:

a detachable head band formed to have a shape wearable on a temporal region.

3. The headset according to claim 2, further comprising:

a connection adapted to transmit a signal of the electronic device to the outside.

4. The headset according to claim 2, wherein the head band is turnably attached.

5. The headset according to claim 3, wherein the connection is one of wired and wireless.

6. The headset according to claim 2, wherein the head band is turnably attached.

7. The headset according to claim 3, wherein the electronic device is a microphone.

* * * * *